United States Patent [19]

Wagner et al.

[11] Patent Number: 4,621,441

[45] Date of Patent: Nov. 11, 1986

[54] PERSONALIZED SHOE EMBLEM SIGNATURE

[75] Inventors: Keith R. Wagner, 490 Jefferson Ave., Brooklyn, N.Y. 11221; Richard L. Miller, Dix Hills, N.Y.

[73] Assignee: Keith R. Wagner, Brooklyn, N.Y.

[21] Appl. No.: 694,132

[22] Filed: Jan. 23, 1985

[51] Int. Cl.[4] ..... A44C 3/00

[52] U.S. Cl. ..... 40/2 E; 40/618

[58] Field of Search ..... 40/2 E, 620, 618, 908, 40/315, 586, 600, 595, 594

[56] References Cited

U.S. PATENT DOCUMENTS 1,952,409 3/1934 Berg ..... 40/2 E 4,480,399 11/1984 Teti, Jr. ..... 40/618

*Primary Examiner*—Gene Mancene

*Assistant Examiner*—Cary E. Stone

*Attorney, Agent, or Firm*—Richard L. Miller

[57] ABSTRACT

A personalized shoe emblem signature having a hollow rectangular shaped frame on to which is placed at least one removable emblem which sandwiches the frame and attaches the personalized shoe emblem signature to the shoe by VELCRO ®.

1 Claim, 4 Drawing Figures

PERSONALIZED SHOE EMBLEM SIGNATURE

BACKGROUND OF THE INVENTION

The present invention relates to a personalized shoe emblem signature. More particularly, it relates to ornaments for personalizing the appearance of shoes.

Personalized ornaments for shoes of the above-mentioned general type are known in the art.

When a person buys a pair of shoes, he or she wishes to personalize them with the appropriate initials. In order to accomplish this, the shoe store would either need an infinite supply of shoes with different combinations of initials or a way to personalize accordingly each particular pair of shoes purchased. The way to personalize each pair of purchased shoes must be simple, efficient, convenient, and cost effective.

SUMMARY OF THE INVENTION

Accordingly, the primary object of the present invention is to provide a personalized shoe emblem signature that avoids the disadvantages of the prior art.

Another object of the present invention is to provide a personalized shoe emblem signature that is simple to use, efficient in its holding power and convenient to use.

Yet another object of the present invention is to provide a personalized shoe emblem signature that is readily interchangeable.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
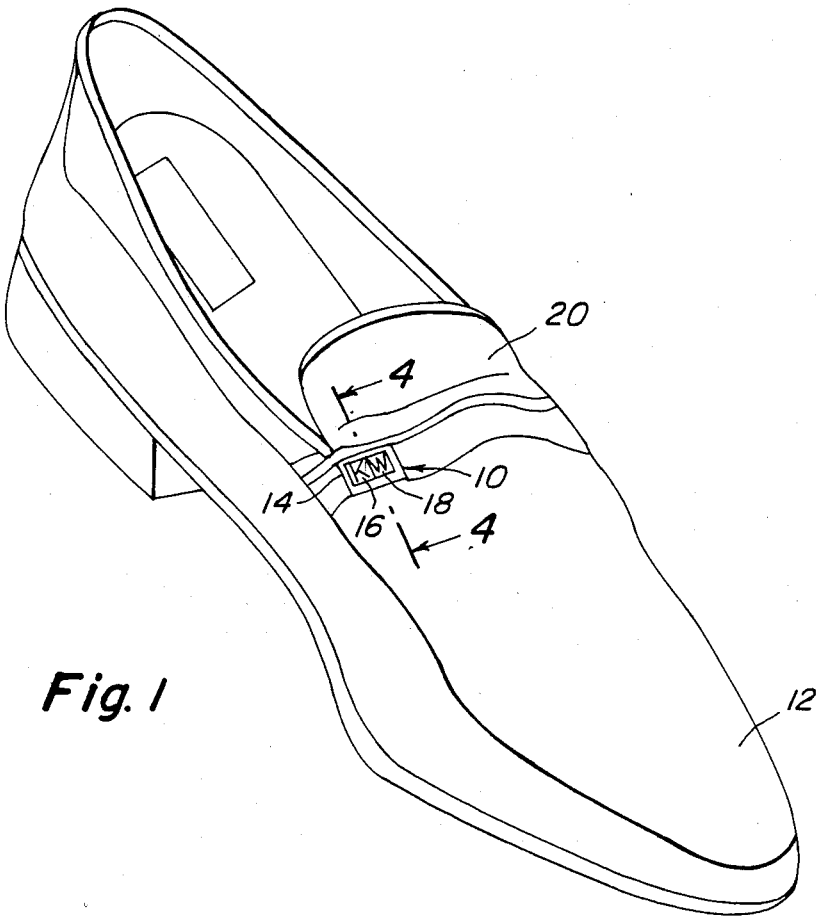
FIG. 1 is a perspective view of a shoe with the invention installed thereon.

Referring now to FIG. 1, the personalized shoe emblem signature of the present invention is shown generally at 10 attached to a shoe 12.

The personalized shoe emblem signature 10 includes a frame 14 and two independent letters 16 and 18. The personalized shoe emblem signature 10 attaches to the shoe 12 in the proximity of the shoe tongue 20.

Figure 2:
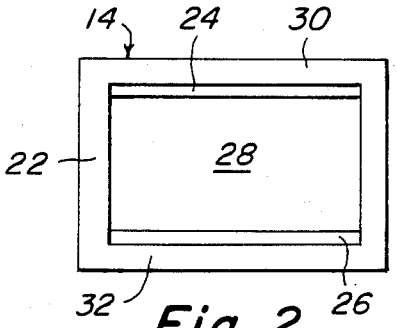
FIG. 2 is a top view of the invention frame member.

The frame 14 is shown in greater detail in FIG. 2. The frame 14 consists of a hollow rectangularly shaped perimeter 22 having two lips 24 and 26 disposed on the internal portion 28 of the two long sides 30 and 32 of the perimeter 22.

Figure 3:
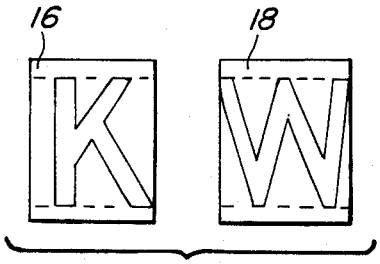
FIG. 3 is a top view of the typical initial members.

The two independent letters 16 and 18 are shown enlarged in FIG. 3.

Figure 4:
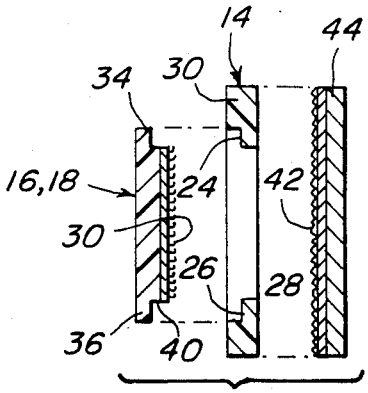
FIG. 4 is an exploded cross sectional view taken along line 4—4 in FIG. 1.

The mounting arrangement for the personalized shoe emblem signature 10 is shown in FIG. 4. The independent letter 16 or 18 includes two projections 34 and 36 disposed on its upper and lower sides. The two projections 34 and 36 extend only partially the depth of the two independent letters 16 and 18. A sheet of VELCRO® 38 is located on the reduced rear side 40 of each of the two independent letters 16 and 18. The reduced rear side 40 passes through the hollow internal portion 28 of the frame 14 so that the projections 34 and 36 seat on the lips 24 and 26, respectively. A mating sheet of VELCRO® 42 is attached to a portion 44 of the shoe 12. VELCRO® 42 mates with VELCRO® 38 of the letters 16, 18 and sandwiches the frame 14. This holds the entire personalized shoe emblem signature 10 to the shoe 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A personalized shoe emblem signature comprising:

(a) a frame having a hollow central portion, a uniformly flat rear portion, and including two lips disposed in said hollow central portion;

(b) at least one emblem removably disposed on said hollow central portion of said frame and including a projection disposed on its top and bottom sides for seating onto said two lips, and a rear side covered with VELCRO®, said rear portion of said frame being free of any VELCRO®; and (c) means for simultaneously removably mounting said frame and said at least one emblem to each other and to said shoe so that said frame is interchangeable from said emblem and from said shoe, and said at least one emblem is interchangeable from said frame and from said shoe, and thus permitting a personal choice of said frame and said at least one emblem by a user, wherein said mounting means include said at least one emblem being placed in said hollow central portion of said frame so that said projections seat on said lips of said frame, and said VELCRO® of said at least one emblem matching with a VELCRO® affixed on said shoe so that said frame is removably sandwiched and retained only by means of said at least one emblem, and said personalized shoe emblem signature is formed and attached to said shoe.

* * * * *